US006149734A

United States Patent [19]

Isogai et al.

[11] Patent Number: 6,149,734

[45] Date of Patent: Nov. 21, 2000

[54] METHOD FOR HEAT TREATMENT OF STEEL

[75] Inventors: Takefumi Isogai; Ryuichi Uchino; Masahiko Sato; Yoshio Kono, all of Aichi-ken, Japan

[73] Assignee: Aisin Seiki, Kabushiki Kaisha, Kariya, Japan

[21] Appl. No.: 09/200,766

[22] Filed: Nov. 27, 1998

[30] Foreign Application Priority Data

Nov. 27, 1997 [JP] Japan ..... 9-326594
Oct. 19, 1998 [JP] Japan ..... 10-296671

[51] Int. Cl.[7] ..... C23C 8/22; C23C 8/46; C23C 8/66

[52] U.S. Cl. ..... 148/233; 148/225; 148/319

[58] Field of Search ..... 148/225, 319, 148/233

[56] References Cited

U.S. PATENT DOCUMENTS

| | | | |
|---|---|---|---|
| 3,382,064 | 5/1968 | Jatczak | 75/123 |
| 3,891,474 | 6/1975 | Grange | 148/16.5 |
| 5,084,116 | 1/1992 | Mitamura | 148/319 |
| 5,413,643 | 5/1995 | Murakami et al. | 148/319 |
| 5,556,348 | 9/1996 | Kokubu et al. | 476/40 |
| 5,595,610 | 1/1997 | Maeda et al. | 148/233 |
| 5,676,769 | 10/1997 | Kawamura et al. | 148/206 |
| 5,853,502 | 12/1998 | Aihara et al. | 148/319 |
| 5,944,916 | 8/1999 | Chung | 148/229 |

*Primary Examiner*—Daniel J. Jenkins
*Assistant Examiner*—Nicole Coy
*Attorney, Agent, or Firm*—Oblon, Spivak, McClelland, Maier & Neustadt, P.C.

[57] ABSTRACT

A method for the heat treatment of steel, comprising carburization hardening said steel, to form carburized steel, followed by a second hardening, reduces the grain size of steel while precipitating carbonitrides inside the grains of steel, thereby increasing the strength of the heat-treated steel. The carburization hardening comprises heating the steel to a first austenitic temperature range in an atmosphere comprising a carburizing gas and optionally ammonia, cooling the steel to a martensitic temperature range, and quenching the steel, and the second hardening comprises heating the carburized steel to a second austenitic temperature range in an atmosphere comprising a carburizing gas and ammonia, and quenching the steel.

20 Claims, 5 Drawing Sheets

Fig.2

| Cooling Method | Cooling Speed | Educing Formations on the Outer Layer | Grain Size of Steel (Gc)No. | Amount of Carbonitrides (piece/ $\phi$ 10 $\mu$ m) |
|---|---|---|---|---|
| Oil Controlling | high | martensite and remaining austenite | 13 | 48 |
| Air Controlling | ↑ | martensite and bainite (plus remaining austenite) | 12 | 42 |
| Leave at Normal Temperature | ↓ | bainite and ferrite·pearlite | 10.5 | 23 |
| Leave in the Furnace | low | ferrite·pearlite | 10 | 20 |

Fig.3

| First Heating Temperature of the Treatment T3 (℃) | Amount of Carbonitrides (piece/ $\phi$ 10 $\mu$ m) |
|---|---|
| 860 | 26 |
| 850 | 31 |
| 840 | 48 |

Fig.4

| ΔT(℃) | Second Heating Temperature of the Treatment T3 (℃) | Amount of Carbonitrides (piece/ $\phi$ 10 $\mu$m) |
|---|---|---|
| 0 | 840 | 23 |
| 10 | 830 | 36 |
| 20 | 820 | 48 |
| 30 | 810 | 55 |

Fig.5

| | Samples of First Embodiment | Samples of Second Embodiment | Conventional Samples |
|---|---|---|---|
| Fatigue Strength ($kgf/mm^2$) | 57 | 62 | 52 |
| Pitting Strength (rolling cycles) | $3.0\times10^6$ | $6.5\times10^6$ | $1.8\times10^6$ |
| Impact Strength ($kgf/mm^2$) | 2.6 | 2.9 | 2.2 |

METHOD FOR HEAT TREATMENT OF STEEL

BACKGROUND OF THE INVENTION

1. Field of the Invention

The present invention relates to a method for heat treating steel or more precisely, a method for reducing the grain size of steel and precipitating carbonitrides in steel to thereby increase the strength of the steel.

2. Discussion of the Background

Various types of heat treatments for improving the strength of steel are known, including, for example, carbonitridation hardening, induction hardening, quenching, tempering, etc. In general, hot-rolled or cold-rolled carbon steel or middle- or low-alloy steel, or hot-forged steel is cut, shaped, and subjected to any of these heat treatments in which the steel is heated up into the austenitic range, thereby increasing the hardness of the steel surface or the entire steel, and increasing the strength of the thus heat-treated steel.

However, the original austenitic grain size of steel as treated according to the conventional heat treatment noted above could be only No. 8 or so in terms of the JIS steel grain size (Gc). Therefore, the conventional heat-treated steel does not always exhibit satisfactorily increased strength when used in transmission gears or the like, where it is exposed to severe environments that require high fatigue strength, pitting strength and impact strength.

In examined Japanese Patent Application No. hei 7-13294, there is disclosed a carbonitriding method for heat treatment reducing of steel for reducing the grain size of the steel to thereby increase the strength of the steel. The method comprises a carburization hardening step of heating the steel, which includes chromium, in an atmosphere containing a carburizing gas, cooling it down under the A, transformation point of the steel and quenching it, followed by a second hardening step of heating up the thus-carburized steel between 850 and 900° C. so as to reduce the grain size of the steel and resolve chromium carbide, treating carbonitriding to educe carbonitrides on the outer layer of the steel in an atmosphere between 800 and 850° C. and there after again quenching. However, in this method, there is no description about cooling speed from the beginning to the end of the cooling down of the steel during the carburization hardening step. If the cooling speed is too slow, sufficient martensitic formation in the outer layer of the steel is not obtained. Therefore, the steel is not sufficiently increased in strength because the grain size of the steel is not sufficient reduced and there is only a small amount of enduced carbonitrides.

SUMMARY OF THE INVENTION

Given that situation, the subject matter of the present invention is to provide a method for heat treating steel, in which the grain size of the steel treated is much more reduced than that treated in any conventional heat-treating method, and sufficient carbonitrides are formed in the grains of steel treated, thereby making the thus-treated steel satisfactorily increased in strength.

A first aspect of the invention for the heat treatment of steel that solves the problems noted above comprises a carburization hardening step of heating the steel up to an austenitic range in an atmosphere containing a carburizing gas, cooling it down to a martensitic range and quenching, followed by a second hardening step of heating up the thus-carburized steel to an austenitic range in an atmosphere containing a carburizing gas and ammonia, and thereafter again quenching.

While the steel is re-heated in the second hardening step in this method, a large number of austenitic grains are formed around the high-density dislocation nuclei or carbide nuclei having been formed in the martensitic phase in the first carburization hardening step. As a result, the grain size of the steel having been treated according to this method is reduced to a level of around Gc 13 or so, and, in addition, owing to the action of the carburizing gas and the ammonia gas in the second hardening step, carbon and nitrogen penetrate and diffuse into the steel to form a large number of fine intragranular and intergranular carbonitrides inside the grains and around the grain boundaries in the steel, whereby the strength of the heat-treated steel is increased.

A second aspect of the invention for the heat treatment of steel that also solves the problems noted above comprises a carbonitridation hardening step of heating the steel to an austenitic range in an atmosphere containing a carburizing gas and ammonia, cooling it down to a martensitic range and quenching, followed by a second hardening step of heating the thus-carbonitrided steel up to an austenitic range in an atmosphere containing a carburizing gas and ammonia and thereafter again quenching.

According to this means, carbon and nitrogen penetrate into the surface of the steel being treated in an austenitic range in the first carbonitridation hardening step, whereby the dislocation density and the amount of the carbonitrides in the martensite phase to be formed in the steel after quenched are larger than those formed in steel having been only carburized, resulting in the formation of a larger number of nuclei, which are to grow into austenitic grains during re-heated in the second hardening step at the austenitizing temperature of the steel, and therefore the steel will have a larger number of austenitic grains. As a result, the grain size of the thus-treated steel is reduced to a level of around Gc 15 or so, and owing to the action of the carburizing gas and the ammonia gas in the second hardening step, a larger number of fine intragranular and intergranular carbonitrides are formed inside the grains and around the grain boundaries in the steel whereby the strength of the heat-treated steel is greatly increased.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 shows a relationship between cooling speeds after a treatment T2, educing formations on the outer layer of a steel member by the cooling and properties of the steel member after a second hardening step in the first embodiment of the method for heat treatment of steel of the invention;

FIG. 3 shows a relationship between first heating temperatures of a treatment T3 and the amount of carbonitrides of the steel member after a second hardening step in the first embodiment of the method for heat treatment of steel of the invention;

FIG. 4 shows relationships between the temperature differences $\Delta T$, between a first heating temperature of the treatment T3 and a second heating temperature of the treatment T3, and the amount of carbonitrides of the steel member after a second hardening step in the first embodiment of the method for heat treatment of steel of the invention; and FIG. 5 shows test results for fatigue strengths, pitching strengths and impacting strengths of the steel members with respect to the first and second embodiments of the method for heat treatment of steel of the invention and a conventional method for heat treatment of steel.

DETAILED DESCRIPTION OF THE INVENTION

Figure 1:
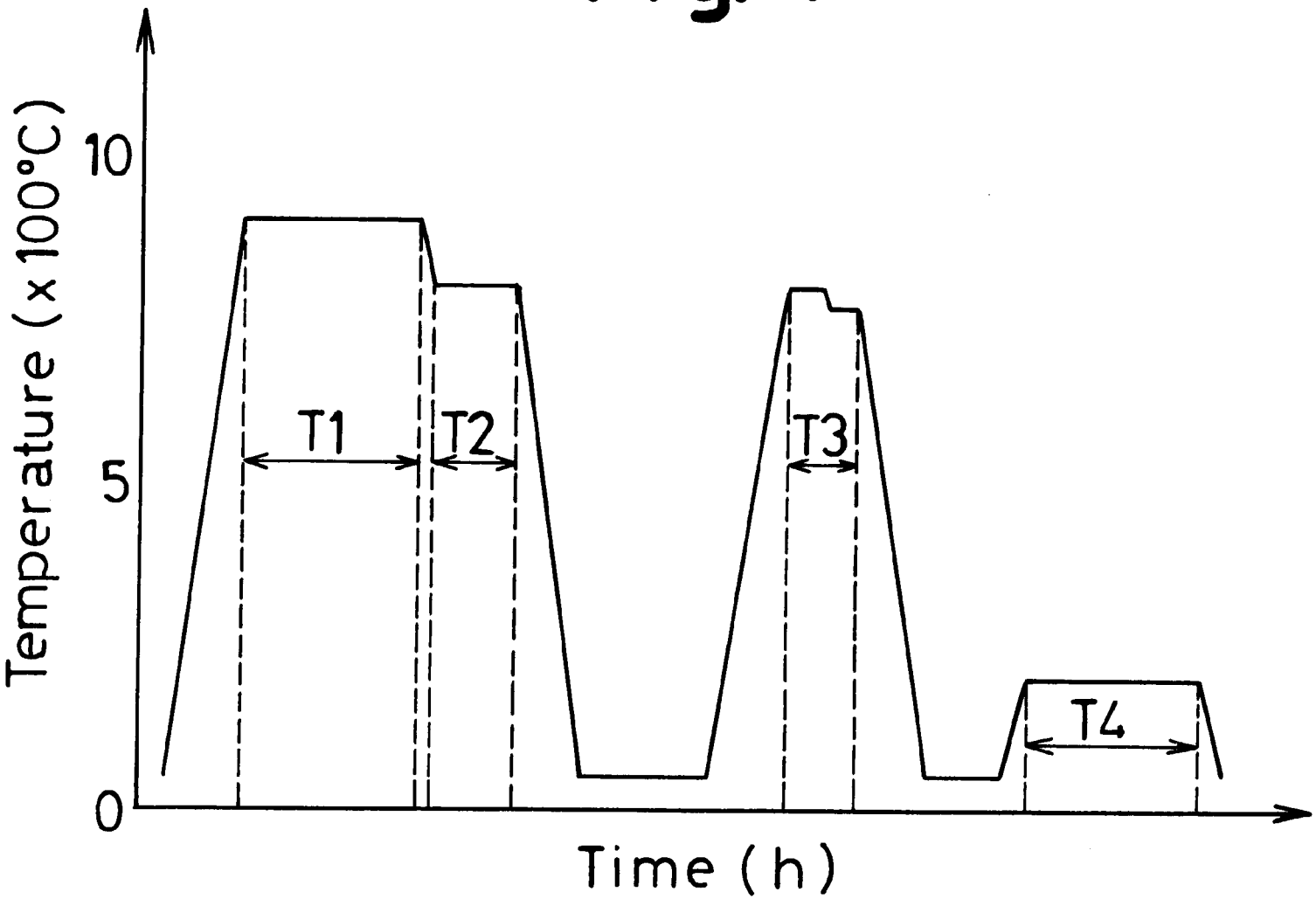
FIG. 1 shows a heat pattern in the first and second embodiments of the method for heat treatment of steel of the invention.

Embodiments of the method for heat treatment of steel of the invention are described hereinunder with reference to the drawings attached hereto.

First described is the first embodiment of the invention. As shown in FIG. 1, the heat treatment in the first embodiment comprises four treatments: T1 to T4. In the step of treatment T1, steel, for example SCr420, is heated to a temperature between 900 and 950° C. in an atmosphere containing carbon, preferably with a Carbon Potential (CP, the ratio of carbon to the atmosphere) of 0.75%, whereby it is carburized, and carbon is diffused into the surface of the steel member. The original carbon content of the non-treated steel member is 0.2%, and the steel member is so carburized in the step of treatment T1 that the carbon concentration in the surface of the treated steel may fall between 0.7 and 1.0%. The heat treatment T1 takes a few hours.

Next, in the step of treatment T2, the temperature of the steel member is lowered to between 820 and 870° C. in an atmosphere containing a carburizing gas, preferably with a Carbon Potential (CP) of 0.75%, so that the steel member is carburized. The treatment T2 takes from 20 to 60 minutes. The steel member is quenched in oil, so that the temperature of the steel member becomes 120° C., and it is subjected to treatment T3. Hence, the treatments T1, T2 and the above quenching treatment correspond to the carburization hardening step of the invention.

The treatment T3 and next quenching treatment are the second hardening step of the invention, in which the steel member is carbonitrided in an atmosphere that contains a carburizing gas and ammonia, preferably with a Carbon Potential (CP) of 0.75% and a Nitrogen Potential (NP, the ratio of nitrogen to the atmosphere) of 0.2%, at a temperature between 800 and 850° C. for a period of from 20 to 60 minutes, and then quenched. As shown in FIG. 1, the treatment T3 includes first and second heating temperatures. In the treatment T3, the steel member is heated at the first heating temperature, for example 840° C. for a predetermined period, for example 20 minutes. Then, the steel member is heated at the second heating temperature, for example 820° C. for a predetermined period, for example 15 minutes. Thereafter the steel member is quenched in oil, so that the temperature of the steel member becomes 120° C. After the steel member is quenched in oil, it is subjected to treatment T4. The treatment T4 is a tempering step which is essentially for preventing the quench-cracking of the steel member, and is effected at a temperature between 120 and 200° C. for a few hours.

In the first embodiment noted above, the steel member as treated in the carburization hardening step of the treatments T1, T2 and the above quenching treatment, is transformed from being austenitic to being martensitic, whereby the dislocation density in the surface of the steel is increased and the amount of carbides existing in the surface is also increased. After the carburization hardening step, the steel member is subjected to the second hardening step of the treatment T3 and the above quenching treatment, in which a large number of austenitic grains are formed within the steel member around the high-density dislocation nuclei, and carbide nuclei, which were formed in the martensitic phase in the carburization hardening step. As a result, the grain size of the original austenitic steel member which was treated according to this method, is reduced to a level of around Gc 13 or so. In addition, owing to the action of the carburizing gas and the ammonia gas in the second hardening step, carbon and nitrogen penetrate and diffuse into the steel member to form a large number of fine intragranular and intergranular carbonitrides inside the grains and around the grain boundaries in the steel. Accordingly, the steel member is strengthened.

In the above carburization hardening step, as shown in FIG. 2, educing formations on the outer layer of the steel member vary in proportion to the cooling speed after the treatment T2. According to the variation of the educing formations, after the second hardening step, the properties, for example the grain size of the original austenitic steel member and the amount of carbonitrides in the steel member, are variable. In the above first embodiment, after the treatment T2 is finished, the steel member is quenched in oil. Therefore, martensitic formations are certainly obtained on the outer layer of the steel member, the grain size of the steel member is reduced and the amount of educing carbonitrides in the steel member is increased. Hence, the relationships between the cooling speeds and the formations on the outer layer of the steel member is variable in accordance with the material of the steel member and Carbon Potential (CP) during the carburization. The relationships are experimentally determined by a continuous cooling transformation diagram.

After the above second hardening step, as shown in FIG. 3, the amount of carbonitrides which are included within the steel member are variable in accordance with the first heating temperatures of the treatment T3. If the first heating temperature is high, the amount of interstitial solid solution of carbon or nitrogen becomes large. Therefore, educed carbides which are educed at the carburization hardening step or the second hardening step, also form interstitial solid solutions. In addition, the amount of the educed carbonitrides becomes small. As the result, the amount of carbonitrides in the steel member is small. On the other hand, if the first heating temperature is low, for example less than 800° C. at some concentration of the interstitial solid solution, both ferrites, which are soft, and grain boundary cementites, which are harmful, are educed on a part of the outer layer of the steel member, such that the strength of the steel member decreases. In the above first embodiment, the first heating temperatures of the treatment T3 is set between 800 and 850° C. such that the amount of the educed carbonitrides are prevent from decreasing, and the formation of abnormal formations is prevented, for example ferrite, and grain boundary cementite. Hence, the amounts of carbonitrides in FIG. 3 results from heating at the above first heating temperature for 20 minutes, and heating at a second heating temperature, which is 820° C., for 15 minutes.

In the second hardening step of the above first embodiment, after a first heating step which heats at a first heating temperature for a predetermined period, a second heating step is carried out, which heats at a second heating temperature for a predetermined period. The second heating temperature is lower than the first heating temperature, the difference being ΔT. A portion of the carbon or nitrogen, which is present as an interstitial solid solution within the steel member, is able to be educed on the steel member as carbides and nitrides. Therefore, the amount of the carbonitrides is increased. FIG. 4 shows some relationships between the temperature differences ΔT and amount of carbonitrides in the steel member. Hence, the amounts of carbonitrides in FIG. 4 results from heating at the above first heating temperature, which is 840° C., for 20 minutes and heating at a second heating temperature, which is ΔT less than 840° C., for 15 minutes. It is clear, as shown in FIG. 4, that the amount of carbonitrides increase in proportion to the increase in the temperature difference ΔT. It is suitable that the second heating temperature is 820° C., because interior portions of the steel member are not hardened if the second heating temperature is too low.

Next, the second embodiment of the invention is described with reference to FIG. 1. In the step of treatment T1, a steel member is heated up to a temperature falling between 900 and 950° C. in an atmosphere containing carbon, as in the first embodiment mentioned above, whereby it is carburized, and carbon is diffused into the surface of the steel member. The original carbon content of the non-treated steel is 0.2%, and the steel is carburized for a few hours in the step of treatment T1 so that the carbon concentration in the surface of the treated steel may fall between 0.7 and 1.0%. Next, in the step of treatment T2, the temperature of the steel is reduced to fall between 820 and 870° C. in an atmosphere containing ammonia in an amount smaller than 1% so that the steel is nitrided. The treatment T2 takes from 20 to 60 minutes. Then, the steel member is quenched in oil, so that the temperature of the steel member becomes 120° C., and it is subjected to treatment T3. Hence, the treatments T1, T2 and the above quenching treatment correspond to the carburization hardening step of the invention. In the above second embodiment, same as in the first embodiment, after the treatment T2 is finished, the steel member is quenched in oil. Therefore, martensitic formations are obtained on the outer layer of the steel member, the grain size of the steel member is reduced and the amount of the educing carbonitrides in the steel member is increased.

A treatment T3 and next quenching treatment are the second hardening step in the invention, in which the steel member is carbonitrided in an atmosphere that contains a carburizing gas and ammonia, at a temperature falling between 800 and 850° C. for a period of from 20 to 60 minutes, and then quenched. The treatment T3, same as the above first embodiment, comprises a first heating step of heating the steel member at a first heating temperature, for example 840° C., for a predetermined period, for example 20 minutes, followed by a second heating step of heating the steel member at the second heating temperature, for example 820° C., for a predetermined period, for example 15 minutes. After the steel member is quenched in oil so that the temperature of the steel member becomes 120° C., the steel member is then subjected to treatment T4. The treatment T4 is a tempering step which is essentially for preventing the quench-cracking of the steel member, and is effected at a temperature falling between 120 and 200° C. for a few hours.

In the second embodiment noted above, the steel member as treated in the carbonitridation hardening step of the treatment T1 and T2 is transformed from being austenitic to being martensitic, whereby the dislocation density in the surface of the steel member is significantly increased and the amount of the carbonitrides existing in the surface is also more significantly increased than in the surface of the steel which has been treated according to the process of the first embodiment. After the carbonitridation hardening step, the steel is subjected to the second hardening step of the treatment T3, in which a larger number of austenitic grains are formed around a larger number of the high-density dislocation nuclei and carbonitride nuclei which were formed in the martensitic phase in the carbonitridation hardening step. As a result, the grain size of the steel member having been treated according to this method is reduced to a level of around Gc 15 or so. In addition, owing to the action of the carburizing gas and the ammonia gas in the second hardening step, a larger number of fine intragranular and intergranular carbonitrides are formed inside the grains and around the grain boundaries in the steel thus having a larger number of grains therein, whereby the strength of the heat-treated steel member is increased.

The steel member (SCr420) having been heat-treated according to any of the first and second embodiments noted above and those (conventional steel samples) having been heat-treated according to a conventional method were tested for the fatigue strength, pitting strength and impact strength, and the test data obtained are shown in FIG. 5. In FIG. 5, the conventional steel members are of conventional carbonitrided SCr420.

The test methods for the strength referred to in FIG. 5 are mentioned below. The fatigue strength test is as follows: Steel rods having a diameter of 20 mm were hot-forged and worked into predetermined shapes. These were heat-treated according to any of the embodiments noted above, and cut into test pieces for fatigue strength. Stress was repeatedly imparted to each test piece, using a rotary bending tester. The maximum stress at which the test piece was not broken after $10^7$ cycles was measured, which indicates the fatigue strength of the test piece.

The pitting strength test is as follows: Test pieces were prepared in the same manner as in the fatigue strength test. An SCM420 roller having been hardened by carburization to have a case-hardened depth of about 0.7 mm was rolled on the surface of each test piece at a bearing pressure of 300 kg.f/mm$^2$ and a slide-roll ratio of 40% in an AT fluid (at about 80° C.), and the number of rolling cycles was counted before the sample was pitted. The number of rolling cycles thus counted indicates the pitting strength of the sample.

The impact strength test is as follows: Square rod samples having a size of 55 mm (length)×10 mm×10 mm were heat-treated according to any of the first and second embodiments noted above, and notched at their center to a depth of R 5 mm. Each sample was hammer at its center, whereupon the energy absorbed by the hammer was measured. The energy thus measured was divided by the area of the cross section of the sample to obtain the impact value having been applied to the sample. The impact value thus obtained indicates the impact strength of the sample.

From the data in FIG. 5, it is obvious that, as a result of the heat treatment according to the first and second embodiments of the invention, the original austenitic grain size in the steel member surface to a depth of hundreds of $\mu$m can be reduced to a level of around Gc 13 and Gc 15, respectively, and, in addition, a large number of intragranular and intergranular fine carbonitrides are formed inside the grains and around the grain boundaries in the heat-treated steel. As compared with those of the conventional steel member, the fatigue strength, the pitting strength and the impact strength of the steel as heat-treated according to the invention are substantially improved. The steel thus provided by the invention is favorable for automatic transmission gears which are subject to pitting.

In the first and second embodiments and their modification described hereinabove, the hardening step is repeated two times in such a manner that the steel having been treated in the first hardening step is rapidly cooled prior to being treated in the second hardening step. However, for high-precision products, the steel having been hardened in the first hardening step could be gradually cooled prior to being subjected to the second hardening step so as to prevent it from having quench distortion.

Throughout the heat-treatment process of the first and second embodiments and their modification mentioned above, CP (Carbon Potential) and NP (Nitrogen Potential) in the ambient atmosphere could be controlled appropriately, thereby selecting the amount of austenite remaining in the surface of the steel to fall between 20 and 70%. In that manner, the mechanical properties of the heat-treated steel, including the pitting strength thereof, may be substantially improved.

As described in detail above, the present invention requires a simple treatment of steel that comprises a carburization hardening step or a carbonitridation hardening step followed by a second hardening step of again heating the steel member to an austenitic range in an atmosphere containing a carburizing gas and ammonia. In the method of the invention, the grain size of the original austenitic steel treated can be greatly reduced, and, in addition, a large number of intragranular and intergranular fine carbonitrides can be formed inside the grains and around the grain boundaries in the steel, whereby the fatigue strength, the pitting strength and the impact strength of the steel are greatly increased.

Obviously, numerous modifications and variations of the present invention are possible in light of the above teachings. It is therefore to be understood that within the scope of the appended claims, the invention may be practiced otherwise than as specifically described herein.

The priority documents of the present application, Japanese Patent Applications 09-326594 and 10-296671, filed on Nov. 27, 1997 and Oct. 19, 1998, respectively, are hereby incorporated by reference.

What is claimed is:

1. A method for the heat treatment of steel, comprising:

carburization hardening said steel, to form carburized steel, followed by a second hardening, wherein carburization hardening comprises heating said steel to a first austenitic temperature range in an atmosphere comprising a carburizing gas, cooling said steel to a martensitic temperature range, and quenching said steel, and said second hardening comprises heating said carburized steel to a second austenitic temperature range in an atmosphere comprising a carburizing gas and ammonia, and quenching said steel.

2. The method of claim 1, wherein said second austenitic temperature range is 800 to 850° C.

3. The method of claim 1, wherein said heating said carburized steel to said second austenitic temperature range comprises heating to a first temperature in an atmosphere comprising said ammonia, followed by heating to a second temperature.

4. The method of claim 3, wherein the second temperature is less than the first temperature.

5. A method for the heat treatment of steel, comprising:

carburization hardening said steel, to form carburized steel, followed by a second hardening, wherein carburization hardening comprises heating said steel to a first austenitic temperature range in an atmosphere comprising a carburizing gas and ammonia, cooling said steel to a martensitic temperature range, and quenching said steel, and said second hardening comprises heating said carburized steel to a second austenitic temperature range in an atmosphere comprising a carburizing gas and ammonia, and quenching said steel.

6. The method of claim 5, wherein said second austenitic temperature range is 800 to 850° C.

7. The method of claim 5, wherein said heating said carburized steel to said second austenitic temperature range comprises heating to a first temperature in an atmosphere comprising said ammonia, followed by heating to a second temperature.

8. The method of claim 7, wherein the second temperature is less than the first temperature.

9. The method of claim 1, wherein said carburized steel has a surface carbon concentration of 0.7 to 1.0%.

10. The method of claim 1, wherein said first austenitic temperature range is 900 to 950° C.

11. The method of claim 1, wherein said martensitic temperature range is 820 to 870° C.

12. The method of claim 1, wherein said quenching is quenching in oil.

13. The method of claim 1, further comprising tempering by heating to 120 to 200° C.

14. The method of claim 5, wherein said carburized steel has a surface carbon concentration of 0.7 to 1.0%.

15. The method of claim 5, wherein said first austenitic temperature range is 900 to 950° C.

16. The method of claim 5, wherein said martensitic temperature range is 820 to 870° C.

17. The method of claim 5, wherein said quenching is quenching in oil.

18. The method of claim 5, further comprising tempering by heating to 120 to 200° C.

19. The product produced by the method of claim 1.

20. The product produced by the method of claim 5.

* * * * *